US007686641B2

(12) United States Patent
Farahani

(10) Patent No.: US 7,686,641 B2
(45) Date of Patent: Mar. 30, 2010

(54) WIRE PIERCING ELECTRICAL CONNECTOR

(75) Inventor: Fereidoun A. Farahani, Woodbridge, CT (US)

(73) Assignee: Nexus, Incorporated, Stamford, CT (US)

( * ) Notice: Subject to any disclaimer, the term of this patent is extended or adjusted under 35 U.S.C. 154(b) by 0 days.

(21) Appl. No.: 12/143,295

(22) Filed: Jun. 20, 2008

(65) Prior Publication Data

US 2009/0318011 A1 Dec. 24, 2009

(51) Int. Cl.
*H01R 4/24* (2006.01)

(52) U.S. Cl. ..... 439/411

(58) Field of Classification Search ..... 439/411, 439/417, 419, 404, 425
See application file for complete search history.

(56) References Cited

U.S. PATENT DOCUMENTS

| | | | | | |
|---|---|---|---|---|---|
| 1,342,819 | A | * | 6/1920 | Lake | 439/805 |
| 2,267,449 | A | * | 12/1941 | Eby | 439/411 |
| 2,745,065 | A | * | 5/1956 | Maher | 333/136 |
| 3,320,385 | A | * | 5/1967 | Sherwood | 337/187 |
| 3,786,173 | A | | 1/1974 | Vogt | |
| 3,907,395 | A | | 9/1975 | Flanagan | |
| 3,977,752 | A | * | 8/1976 | Freitag | 439/411 |
| 3,982,319 | A | * | 9/1976 | Bice | 29/868 |
| 4,032,210 | A | | 6/1977 | Vogt | |
| 4,662,699 | A | * | 5/1987 | Vachhani et al. | 439/395 |
| 4,969,839 | A | | 11/1990 | Nilsson | |
| 5,167,526 | A | * | 12/1992 | Pinyan et al. | 439/411 |
| 5,305,547 | A | | 4/1994 | Weiss | |
| 5,439,388 | A | | 8/1995 | Weiss et al. | |
| 5,496,192 | A | * | 3/1996 | Hower et al. | 439/409 |
| 5,514,006 | A | * | 5/1996 | Getselis et al. | 439/417 |
| 5,989,056 | A | * | 11/1999 | Lange et al. | 439/412 |
| 6,364,690 | B1 | * | 4/2002 | Nehm-Engelberts | 439/412 |
| 6,443,756 | B1 | * | 9/2002 | Hagmann et al. | 439/402 |
| 6,644,998 | B2 | * | 11/2003 | Kaufmann et al. | 439/412 |
| 6,752,647 | B1 | * | 6/2004 | Lin | 439/412 |
| 2005/0142925 | A1 | * | 6/2005 | Mugnaini | 439/411 |

* cited by examiner

*Primary Examiner*—T C Patel
*Assistant Examiner*—Vladimir Imas
(74) *Attorney, Agent, or Firm*—St. Onge Steward Johnston & Reens LLC

(57) ABSTRACT

A wire piercing connector assembly, including a body including a cavity having two or more conductive protrusions, a disk connectable into the cavity, the disk including a first side and a second side, a plurality of channels extending from the first side to the second side of the disk, wherein each channel includes two first openings on the first side and one second opening on the second side, two or more wires, each wire extending into one of the first openings of one of the channels and at least partially out another of the first openings of the channel, and wherein at least one of the conductive protrusions extends into the second opening of the channel and at least partially pierces the wire to establish an electrical connection between the at least one conductive protrusion and the wire.

20 Claims, 5 Drawing Sheets

WIRE PIERCING ELECTRICAL CONNECTOR

FIELD OF THE INVENTION

The invention relates to an electrical connector, and more specifically to a multi-circuit electrical connector with wire piercing connection means.

BACKGROUND OF THE INVENTION

Many different electrical connectors and multi-circuit electrical connectors are known. Some connectors include barbs or other means for piercing leads to establish a connection. For example, commonly owned U.S. Pat. No. 3,907,395 to Flanagan discloses a multi-circuit electrical connector with a compression member that compresses leads into piercing engagement with barbs to effectuate an electrical connection.

U.S. Pat. No. 5,305,547 to Weiss discloses an electrical connector arrangement that includes a wire support block. The block includes wire-guide channels across a surface of the block and axial slots traverse to the channels for receiving blades. U.S. Pat. No. 4,969,839 to Nilsson discloses an electrical connector including a cable holder with a plurality of slots about the holder for receiving individual conductors. Insulation piercing conductor members pierce each individual conductor when the assembly is nested. Weiss and Nilsson each disclose slots on the exterior of a portion of the connector in which a wire is laid prior to assembly. Thus, the wires are not held securely in place prior to assembly and may become misaligned or may make contact with one another.

U.S. Pat. No. 4,032,210 to Vogt discloses an electrical splice including an end member slideably receivable within a center member. The end member includes channels through which a conductor is threaded. The conductor is contacted by a shorting pin upon assembly. U.S. Pat. No. 3,786,173 to Vogt similarly discloses an electrical splice including an end piece with conductor channels and conductor recesses. Conductors are passed thorough a channel, into a recess and contacted by a shorting pin. In each of the Vogt patents, a wire is threaded through a channel and into a recess. The wire does not extend completely through the connector and is still therefore prone to falling out or becoming misaligned. Furthermore, the Vogt connectors only accommodate two wires.

What is desired is an electrical connector with a simple and reliable means for establishing electrical connections for multiple circuits. What is also desired is an electrical connector with a secure means for retaining each of a plurality of leads in the connector.

SUMMARY OF THE INVENTION

Accordingly, it is an object of the present invention to provide a multi-circuit electrical connector with a connector disk or plate for retaining a plurality of leads and engaging conductive protrusions.

These and are objects are achieved by providing a wire piercing connector assembly, including a body including a cavity having two or more conductive protrusions, a disk connectable into the cavity, the disk including a first side and a second side, a plurality of channels extending from the first side to the second side of the disk, wherein each channel includes two first openings on the first side and one second opening on the second side, two or more wires, each wire extending into one of the first openings of one of the channels and at least partially out another of the first openings of the channel, and wherein at least one of the conductive protrusions extends into the second opening of the channel and at least partially pierces the wire to establish an electrical connection between the at least one conductive protrusion and the wire.

Other objects are achieved by providing a method of establishing an electrical connection, including the steps of providing a disk including a plurality of channels extending through the disk, wherein each channel includes at least two openings on a first side of the disk and at least one second opening on a second side of the disk, inserting each of a plurality of leads into the disk in a first direction through one of the first openings and at least partially out of a second one of the first openings in a second direction, wherein the second direction is substantially opposite to the first direction, inserting the disk into a cavity of a connector body, wherein the cavity includes a plurality of conductive protrusions, and piercing each of the leads within the channels with at least one of the conductive protrusions during the inserting of the disk to establish an electrical connection.

Other objects of the invention and its particular features and advantages will become more apparent from consideration of the following drawings and accompanying detailed description.

DETAILED DESCRIPTION OF THE INVENTION

Figure 1:
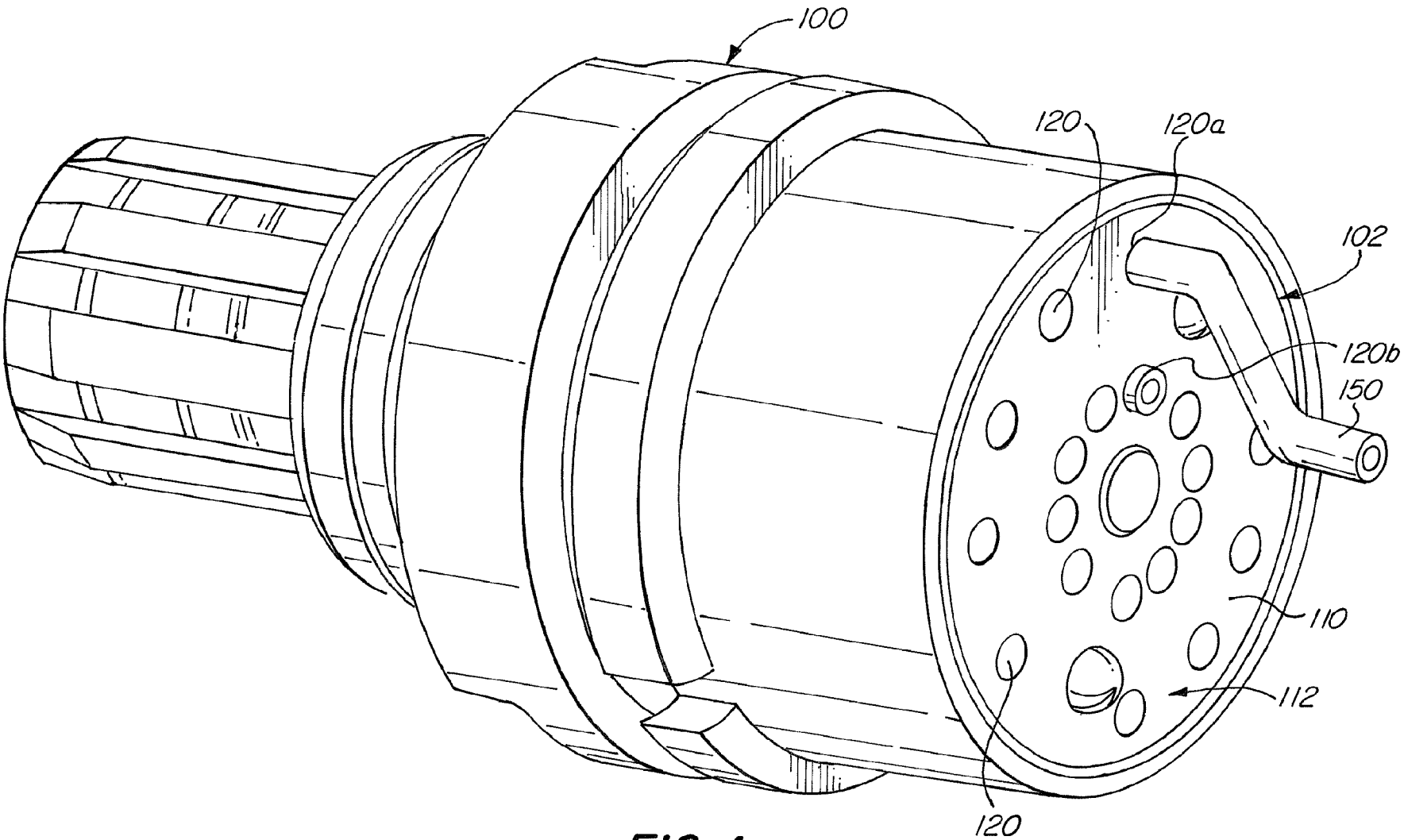
FIG. 1 illustrates an electrical connector assembly according to an exemplary embodiment of the present invention.
Figure 2:
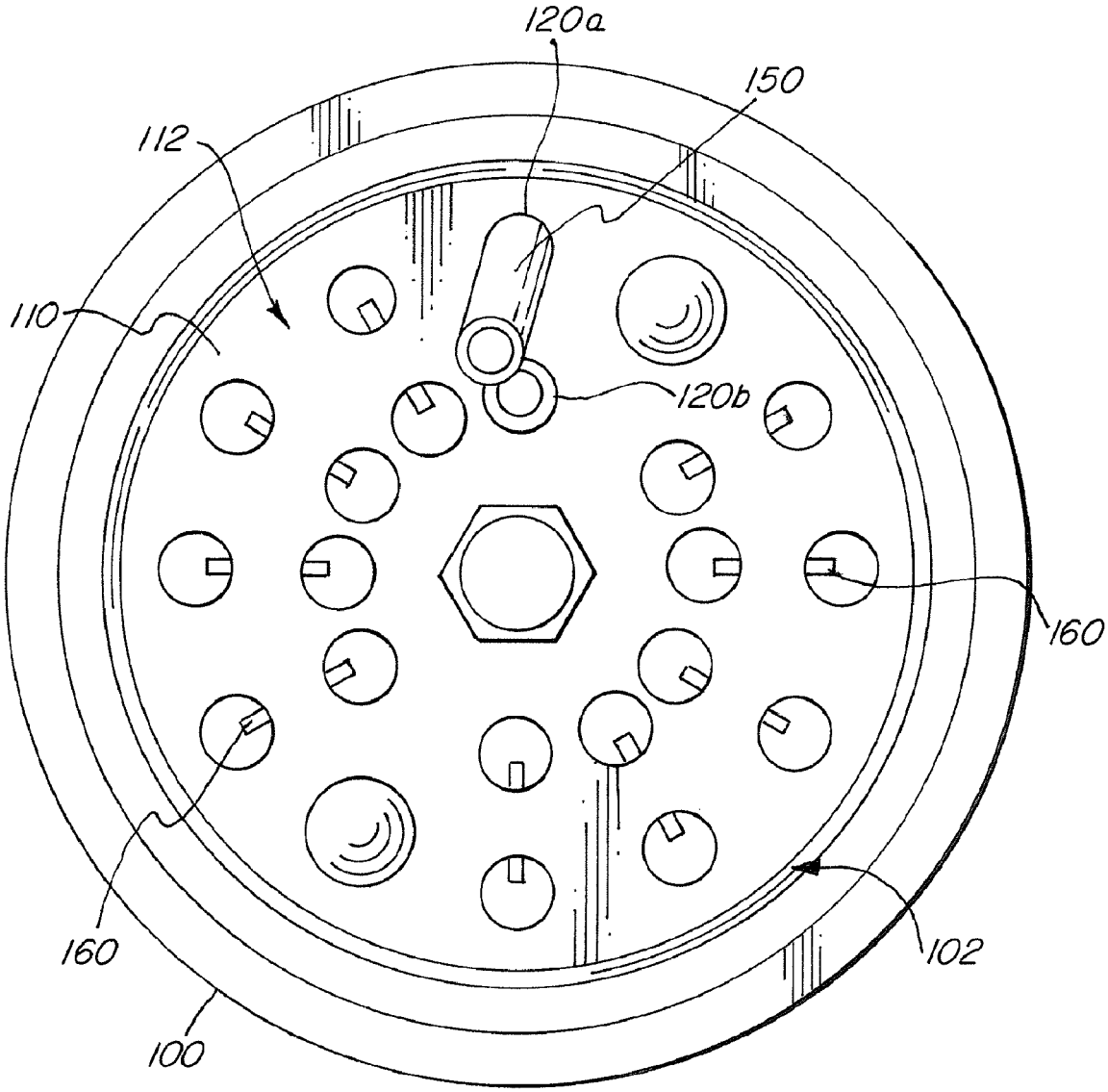
FIG. 2 is a front view of the electrical connector assembly shown in FIG. 1.

FIGS. 1 and 2 show an electrical connector assembly according to an exemplary embodiment of the present invention. The connector assembly includes a body 100. The body 100 may be comprised of any suitable material such as a plastic or polymer. The body 100 includes a first end including a cavity 102 and a plate or disk 110 insertable into the cavity 102.

The disk 110 is preferably circular including a plurality of channels extending through the disk 110. In the exemplary embodiment, the channels are arranged radially and are approximately equal spaced about the disk 110 (see, e.g., FIG. 2). The disk 110 includes a first side 112 adapted to face external to the cavity 102 and a second side 114 adapted to face internal to the cavity 102. Each of the channels includes at least two first openings 120 on the first side 112 and at least one second opening 130 on the second side 114. In preferred embodiments, the channels are substantially "Y" shaped wherein the first openings 120 and the second opening 130 intersect within the disk 110.

Figure 4A:
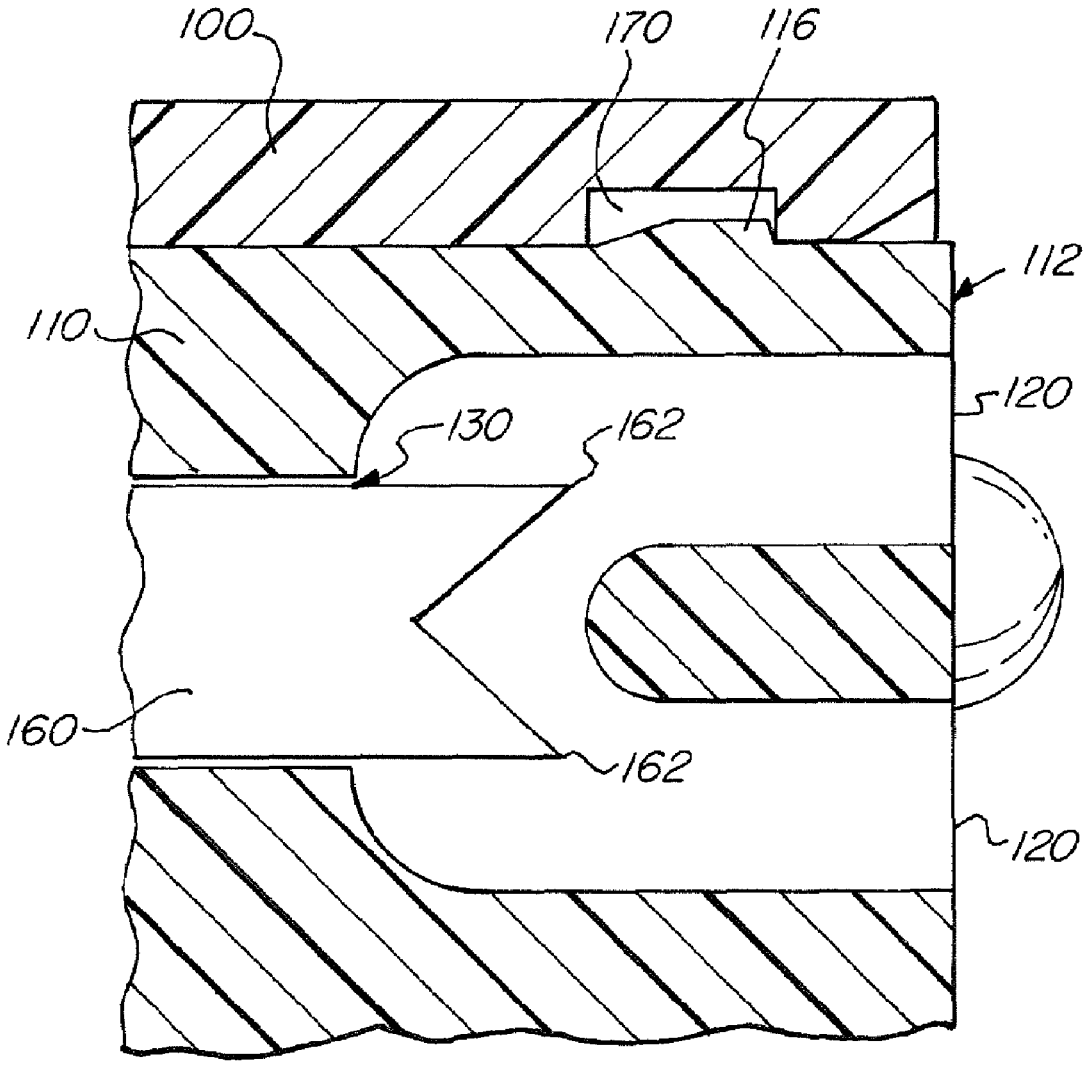
FIG. 4A is a partial cutaway view of the electrical connector assembly shown in FIG. 1.
Figure 4B:
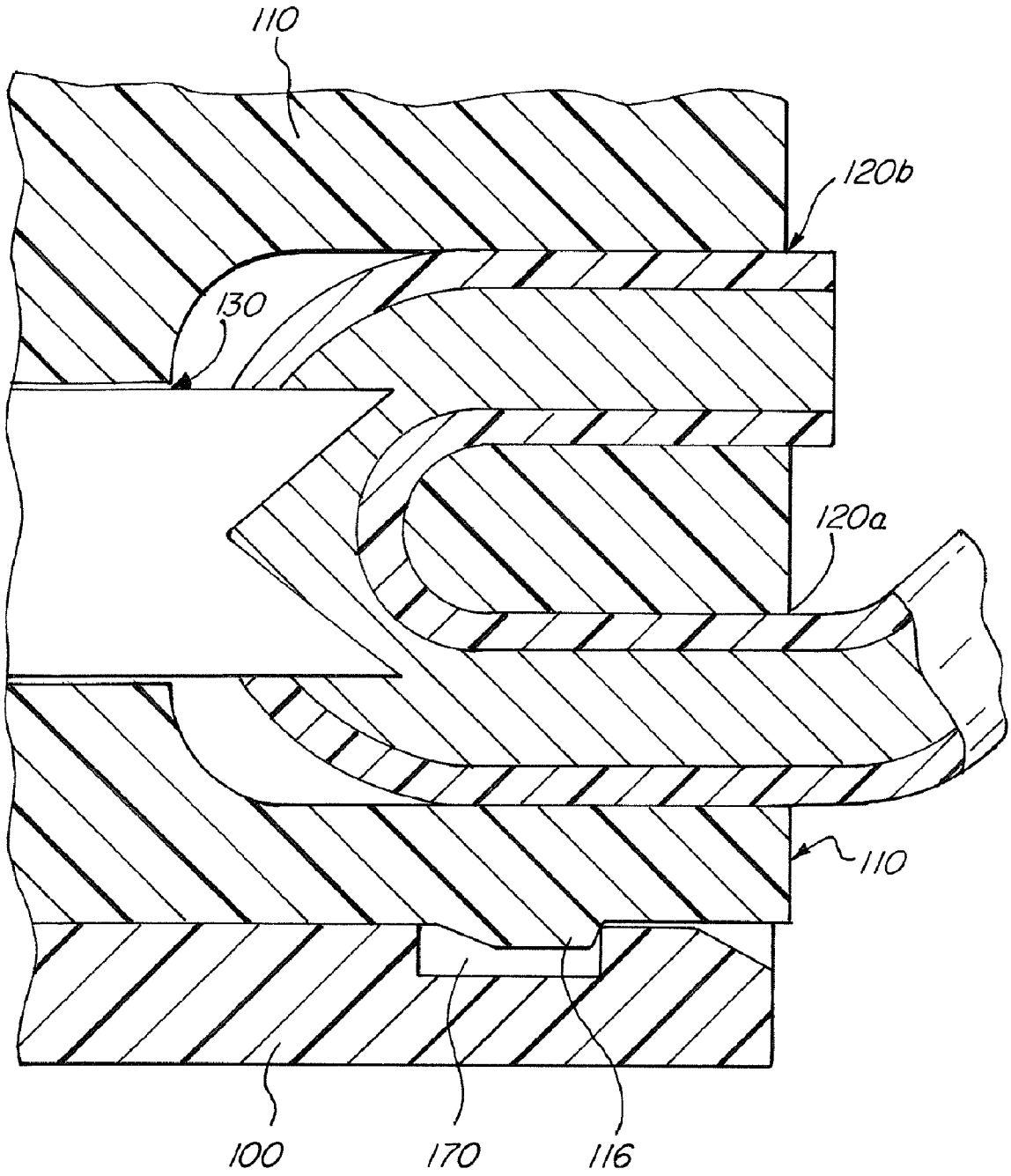
FIG. 4B is another partial cutaway view of the electrical connector assembly shown in FIG. 1.

The electrical connector assembly receives a plurality of leads or wires 150. Each wire 150 extends into one of the first openings 120*a* of a channel and at least partially out of another of the first openings 120*b* of the channel. The wires 150 are extended through the disk 110 prior to inserting the disk 110 into the cavity 102. For example, during assembly each wire 150 may be extended into a first opening 120*a* in the first side and out the corresponding second opening 130 in the second side the plate. The wire 150 is then extended back through the second opening and another first opening 120*b* to arrange the wire as shown in FIG. 4B. This arrangement securely holds the wire 150 in the channel with minimal risk of the wire 150 falling out or becoming misaligned. This arrangement also provides for the electrical connection point to be within the disk 110 to prevent shorting. Each of the wires 150 are connected to the disk 110 in the same manner via different channels. The disk 110 is then inserted in the cavity 102.

Figure 3:
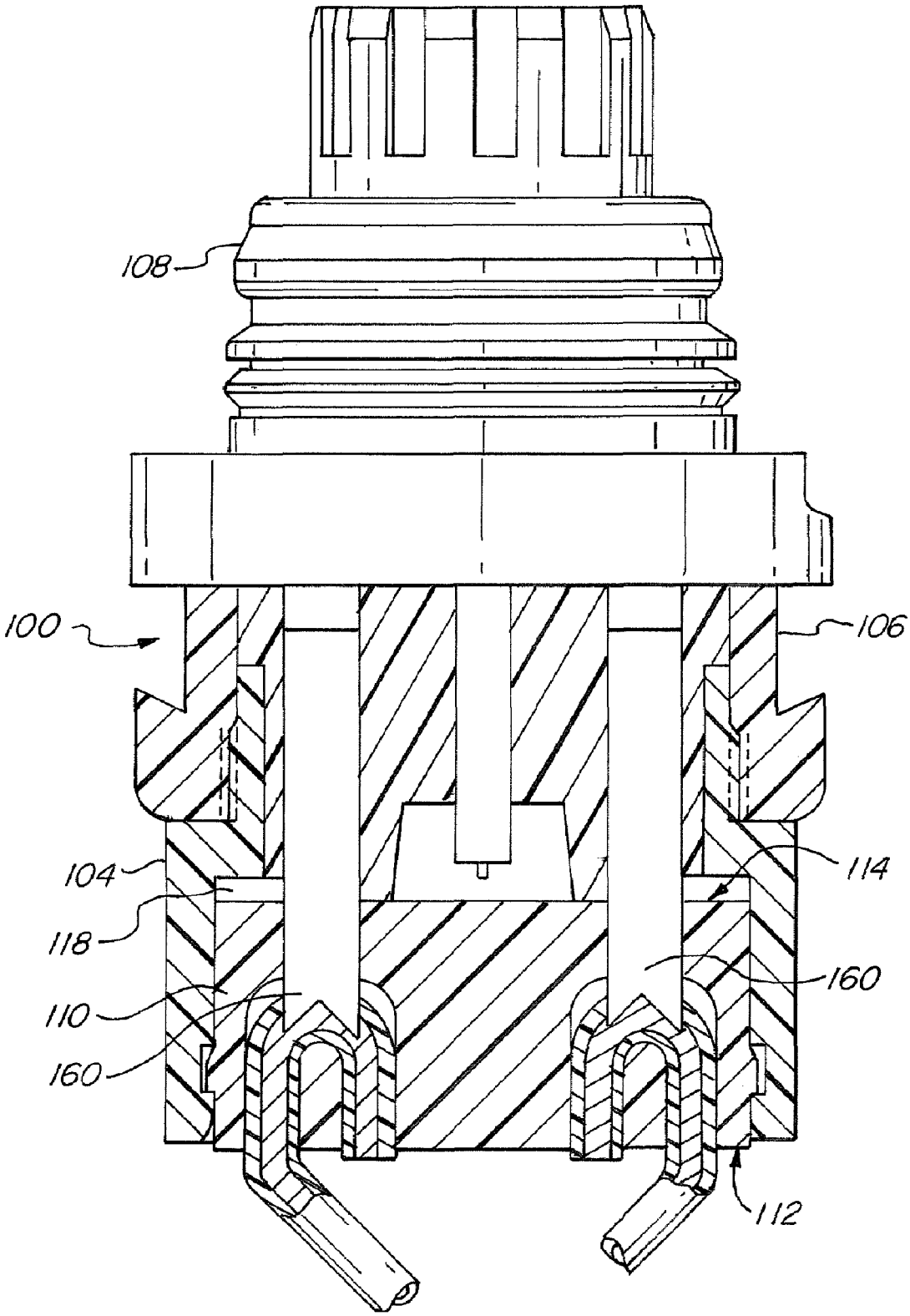
FIG. 3 is a cutaway side view of the electrical connector assembly shown in FIG. 1.

FIGS. 3-4B shows a cutaway side view of the exemplary electrical connector assembly. In the exemplary embodiment, the body 100 includes a guide 104 connected to a housing 106. The body 100 also includes a plug assembly 108 at a second end of the body 100. In other embodiments, the body 100 includes a jack or socket assembly (not shown). An electrical connector assembly including the plug assembly 108 is adapted to connect to a second electrical connector assembly including a socket assembly.

The connector assembly includes a plurality of conductive protrusions 160 extending via the cavity 102. The protrusions are in conductive communication with the plug assembly 108 (and/or a socket assembly). The protrusions 160 are arranged to extend into the second openings 130 of the channel in the second side 114 of the disk 110. Upon inserting the disk 110 into the cavity 102, each of the protrusions 160 at least partially pierce one of the wires 150 to establish an electrical connection between the particular conductive protrusion 160 and the wire 150. The connector assembly may also include an o-ring 118 between the body 100 and the disk 110.

The disk 110 may be removeably or permanently retained in the cavity 102 upon insertion. In the exemplary embodiment, the cavity 102 includes a groove 170 circumscribing an interior surface of the cavity. The disk 110 includes an annular ring 116. The annular ring 116 engages the groove 170 to retain the disk 110 in the cavity 102. The disk 110 and cavity 102 may also be keyed to ensure that each particular wire 150 connections with an appropriately corresponding conductive protrusion 160.

In some embodiments, the protrusions include two or more prongs 162. As shown in FIG. 4A, each of the prongs 162 are arranged to extend toward or at least partially into one of the first openings 120 of a particular channel. Upon insertion of the disk 110 with wires 150 retained therein, each of the prongs pierce the wire 150 as shown in FIG. 4B.

Although the invention has been described with reference to a particular arrangement of parts, features and the like, these are not intended to exhaust all possible arrangements or features, and indeed many modifications and variations will be ascertainable to those of skill in the art.

What is claimed is:

1. A wire piercing connector assembly, comprising:

a body comprising a cavity having two or more conductive protrusions;

a disk connectable into the cavity, said disk including a first side and a second side;

a plurality of channels extending from the first side to the second side of said disk, wherein each channel includes two first openings on the first side and one second opening on the second side;

two or more wires, each wire extending into one of the first openings of one of the channels and at least partially out another of the first openings of the channel; and wherein at least one of the conductive protrusions extends into the second opening of the channel and at least partially pierces the wire to establish an electrical connection between the at least one conductive protrusion and the wire.

2. The assembly according to claim 1, wherein the electrical connection is established within said disk.

3. The assembly according to claim 1, wherein the two first openings and the second opening of each channel intersect within said disk.

4. The assembly according to claim 3, wherein the electrical connection is established at the intersection of the first openings and the second opening.

5. The assembly according to claim 1, wherein each of the conductive protrusions includes two or more prongs at a distal end.

6. The assembly according to claim 5, wherein each wire is pierced in each of the two first openings in one of the channels.

7. The assembly according to claim 1, wherein said disk is removeably connectable into the cavity.

8. The assembly according to claim 1, wherein the cavity includes a groove circumscribing an interior surface of the cavity, wherein said disk includes an annular ring, wherein the annular ring engages the groove to retain said disk in the cavity.

9. The assembly according to claim 1, wherein said disk is substantially circular, wherein the channels are arranged radially about said disk.

10. The assembly according to claim 1, wherein said body comprises a guide and a housing, wherein the guide receives said disk.

11. The assembly according to claim 1, wherein said two or more wires comprises at least ten wires.

12. The assembly according to claim 1, wherein said body comprises one of a socket and a plug substantially opposite to the cavity adaptable for connection to a second electrical connector assembly.

13. The assembly according to claim 1, wherein each of said disk and the cavity include a key such that said disk is connectable in only one particular arrangement.

14. A method of establishing an electrical connection, comprising the steps of:

providing a disk including a plurality of channels extending through the disk, wherein each channel includes at least two openings on a first side of the disk and at least one second opening on a second side of the disk;

inserting each of a plurality of leads into the disk in a first direction through one of the first openings and at least partially out of a second one of the first openings in a second direction, wherein the second direction is substantially opposite to the first direction;

inserting the disk into a cavity of a connector body, wherein the cavity includes a plurality of conductive protrusions; and piercing each of the leads within the channels with at least one of the conductive protrusions during the inserting of the disk to establish an electrical connection.

15. The method according to claim 14, wherein the conductive protrusions extend into the second openings.

16. The method according to claim 14, wherein the electrical connection is established within one of the channels.

17. The method according to claim 14, wherein each of the conductive protrusions includes at least two prongs at a distal end.

18. The method according to claim 14, wherein said step of inserting the disk includes engaging an annular ring of the disk into a groove circumscribing an interior surface of the cavity.

19. The method according to claim 14, wherein the connector body includes a plug in conductive communication with the conductive protrusions, wherein the method further comprises the step of engaging the plug with a socket of a second connector body.

20. The method according to claim 14, wherein the connector body includes a socket in conductive communication with the conductive protrusions, wherein the method further comprises the step of engaging the socket with a plug of a second connector body.

* * * * *